United States Patent [19]

Easton et al.

[11] Patent Number: 4,656,673

[45] Date of Patent: Apr. 14, 1987

[54] INDIVIDUALLY ATTACHABLE POCKETS FOR ARTICLES OF CLOTHING SUCH AS SHIRTS

[76] Inventors: Joseph E. Easton, 3026 S. Paseo Loua Cir., Mesa, Ariz. 85202; Michael Snider, 1004 S. 21st St., Mesa, Ariz. 85204

[21] Appl. No.: 828,378

[22] Filed: Feb. 11, 1986

[51] Int. Cl.[4] ..... A41D 27/20

[52] U.S. Cl. ..... 2/247

[58] Field of Search ..... 2/247, 246, 244, 248, 2/249

[56] References Cited

U.S. PATENT DOCUMENTS

| | | | |
|---|---|---|---|
| 2,871,485 | 2/1959 | Greco | 2/246 |
| 3,137,865 | 6/1964 | Evans | 2/247 |
| 3,816,211 | 6/1974 | Haigh | 2/246 |
| 4,089,722 | 5/1978 | Holoubek | 2/246 |
| 4,321,710 | 3/1982 | Off | 2/247 |
| 4,349,920 | 9/1982 | Off | 2/247 |
| 4,357,197 | 11/1982 | Wilson | 2/247 |
| 4,513,454 | 4/1985 | Anderson et al. | 2/246 |
| 4,549,916 | 10/1985 | Off et al. | 2/247 |
| 4,576,668 | 3/1986 | Farelly et al. | 2/244 |

*Primary Examiner*—Doris L. Troutman
*Attorney, Agent, or Firm*—Charles P. Padgett, Jr.

[57] ABSTRACT

The present invention discloses an iron-on pocket for a pocketless shirt or similar article of clothing adapted to receive a pocket wherein a piece of pocket material substantially similar or equivalent to the shirt material and cut in the form of a pocket having a top edge, a bottom edge, a pair of sides a front surface, and a rear surface adapted to be operatively disposed against the surface of the shirt or article of clothing designated to receive the pocket. An attachment device including a first layer adapted to be fixedly secured to the interior surface or folded back edge surface of the pocket material proximate the peripheral edge portions of the bottom and sides of the pocket material and a second thermally-activated or heat responsive adhesive layer is fixedly secured to the first layer and has its rear surface adapted to be disposed against the shirt or clothing material in which the pocket is to be mounted. The second layer is responsive to the application of heat applied thereto by iron-on or heat transfer methods for adhesively securing the piece of pocket material to the article of clothing by the two layer attachment strips. The attachment strips are fixedly secured to the rear surface peripheral edges of the sides and bottom of the pocket or to the folded back edges thereof by stitching or the like. The pocket opening is formed between the clothing material and top edge of the pocket material which is not adhesively secured thereto and the interior of the pocket is defined between the portion of the clothing material covered by the pocket and the rear interior surface of the pocket material intermediate the fastening strips.

11 Claims, 4 Drawing Figures

INDIVIDUALLY ATTACHABLE POCKETS FOR ARTICLES OF CLOTHING SUCH AS SHIRTS

BACKGROUND OF THE INVENTION

1. Field of the Invention

The present invention relates generally to pockets for various articles of clothing such as shirts, T-shirts, sweatshirts, and the like, and more particularly to pockets which are provided with attachment strips about the peripheral edges of the rear surfaces thereof for selectively attaching the pocket to a given location on the article of clothing designated to receive the pocket such that the application of heat thereto adhesively bonds said peripheral edges of the pocket to the clothing material for forming a pocket thereon.

2. Description of the Prior Art

The prior art typically teaches that shirt pockets, pants pockets, and various pockets on different articles of clothing or the like are typically sewn onto the clothing material by conventional stitching. The prior art patents teach that the pockets are attached to the articles of clothing at the time of manufacture of the article of clothing itself.

Many of today's shirts are sold without pockets, for example, many types of T-shirts, athletic shirts, sweatshirts, and the like are not manufactured or sold with any type of pockets thereon.

The prior art also teaches permanently affixing logos or other indicia means to the front surface of a pocket and some even show a means for replaceably securing indicia to a pocket or the like by male and female hook and loop attachment means or the like, but no one teaches simply applying a pocket to the article of clothing with the desired indicia or logo being affixed to or printed on the pocket itself.

BRIEF SUMMARY OF THE INVENTION

It is an object of the present invention to provide a pocket which can be fixedly secured to an article of clothing on which it is desired to have a pocket by the application of heat to said pocket material.

It is another object of this invention to provide simple and easy means of attaching pockets to clothing.

It is yet a further object of the present invention to provide iron-on pockets containing logos, indicia means, names, or the like onto a desired article of clothing for advertising purposes and the like.

It is a further object of the present invention to provide an easy means for attaching a piece of pocket material to an article of clothing on which it is desired to form a pocket and which can be permanently secured to the article of clothing without the need for stitching the pocket to the clothing.

It is still another object of the present invention to provide a simple pocket which can be ironed onto any desired article of clothing at any desired location without the need for sewing or the like.

The present invention teaches an iron-on pocket or piece of pocket material for a pocketless shirt, pants, or other article of clothing on which a pocket is desired. The piece of pocket material will generally substantially match or be equivalent to the material of the article of clothing onto which the pocket is to be secured. The pocket material is cut in the form of a conventional pocket having a top, a bottom, and a pair of sides, a front surface and an interior rear surface adapted to be operatively disposed against the shirt or other clothing material onto which the pocket is to be affixed.

A unique attachment means is provided wherein one or more strips of fastening material include a first layer adapted to be fixedly secured to the interior surface of the peripheral edge portions of the bottom and side edges of the pocket material or to a folded in portion thereof such that the second adhesive layer is fixedly secured to the first layer and operatively disposed with its outer surface toward the clothing material onto which the pocket is to be secured. The pocket can be placed at the desired location on the clothing to which it is to be attached such that the second layer has its outer adhesive surface disposed against the clothing material. The second layer is responsive to the application of heat thereon via iron-on techniques, heat transfer techniques, or the like, for adhesively bonding the attachment strips to the clothing material to form a pocket having an opening formed between the unsecured top peripheral edge portion of the pocket material and the adjacent clothing material, with the pocket interior being defined between the clothing material and the central body portion of the pocket defined between the side and bottom edges.

The iron-on pocket of the present invention is designed to have embroidered symbols, designs, logos or names affixed to the outer surface of the pocket or any type of heat transfer or iron-on indicia similarly affixed thereto. Similarly, any type of material fabric design or material fabric letters or words or symbols can be permanently or removably affixed to the front surface of the shirt pocket for advertising purposes or the like.

These and other objects and advantages of the present invention will become more fully understood by reading the description of the preferred embodiment, the claims, and the drawings which are briefly described hereinbelow.

DESCRIPTION OF THE PREFERRED EMBODIMENT

Figure 1:
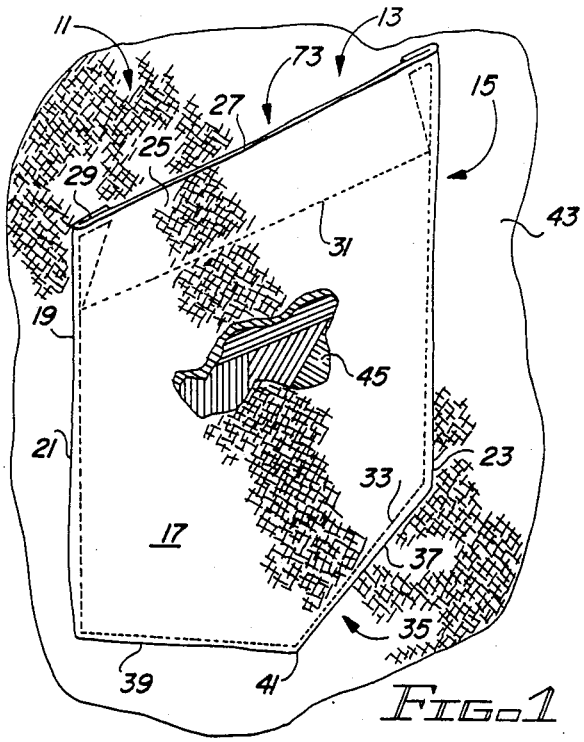
FIG. 1 is a perspective view of the iron-on pocket of the present invention.

FIG. 1 shows an article of clothing 11 which can be a shirt, pair of pants, or any article designed to have a pocket or on which a pocket may be useful. In the preferred embodiment, the clothing material 11 would preferably include various types of material conventionally used in shirts such as sports shirts, T-shirts, undershirts, athletic shirts, pull-overs sweat shirts, jerseys, blouses and the like, which are not ordinarily provided with pockets in the manufacturing stage.

The piece of pocket material 13 includes a piece of pocket material 15 which is chosen to be substantially identical to or compatible with the shirt material 11 to which the pocket 15 is to be attached. The piece of pocket material 15 is preferably cut or otherwise formed or shaped into the shape or configuration of a conventional pocket. The piece of pocket material 15 includes a first side edge 21, an opposite side edge 23, the edges 21 and 23 generally being oriented vertically on the shirt and being substantially parallel to one another. The pocket material 15 also includes a top peripheral edge portion 27 and a bottom peripheral edge portion 35. The bottom peripheral edge portion 35 may be a conventional straight line substantially parallel to the top edge portion 27 or, as shown in FIG. 1, it may be a V-shaped portion comprising a first bottom edge portion 37 and a second bottom edge portion 39. The shape of the pocket itself is insignificant and forms no limitation on the present invention since any size, shape or configuration of pocket can be used with the present invention.

The piece of pocket material 15 is shown in FIG. 1 with the front surface 17 containing an indicia means 45. The indicia means 45 may be, in the preferred embodiment of the present invention, an embroidery, a sewn-on or otherwise attached indicia means containing letters, numbers, designs, symbols or the like; an iron-on or heat transfer indicia or the like. Furthermore, the indicia means 45 may include any of a corporate name, symbol, logo, trademark or the like and may include any type of name, logo, team emblem, or the like, as desired.

A shown in FIG. 1, a portion of the top edge 27 may be folded back upon itself 25 while the peripheral side edge portions 21 and 23 are folded back upon themselves as are the bottom peripheral edge surfaces 37 and 39 and stitched or sewn via stitches 31 and 31 as hereinafter described. Once the pocket 13 is secured to the clothing 11, the pocket opening 73 is defined between the unsecured upper or top edge portion, 25, 27 and the adjacent clothing material, and the pocket interior is defined between the clothing material over which the pocket is disposed and the rear surface 19 of the body portion of the pocket 13.

Figure 2:
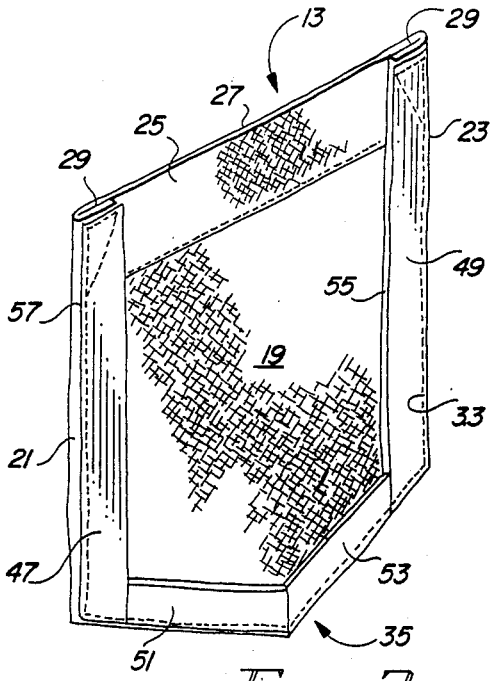
FIG. 2 is a perspective view of the rear surface of the iron-on pocket of FIG. 1.

FIG. 2 shows the rear surface of the pocket 15 of FIG. 1 and it can be seen that the peripheral side edges 21 and 23 are folded back 47, 49 over the rear or attachment surface of the pocket as are the bottom peripheral edge portions 51 and 53. The folded back top peripheral edge 27 may include a folded back portion 25 which is sewn to the opposite surface 19 for forming the top of the pocket.

A strip of fastening material having a first layer adapted to be operatively disposed over the edge portions 47, 49, 51, 53 or folded back edge portions of the sides 21 and 23 and the bottom edge portions 51 and 53 while the outwardly-facing second layer is fixedly secured to the first layer and includes an adhesive surface operably disposed toward the clothing material to which the pocket will be attached. The second layer is responsive to the application of heat applied thereto for forming an adhesive bond between the fastening strip and the surface of the article of clothing to which the pocket is attached for fixedly securing the pocket placed on the article of clothing as previously described. The pocket opening 73 is then formed between the top peripheral edge 27 of the pocket material 15 and the adjacent portion of clothing material 43 while the pocket itself is defined as that area between the body portion of the pocket 13 defined between the edge strips 47, 49, 51 and 53 and the underlying area 19 of clothing material over which the pocket 13 is placed.

In operation, the pocket construction of FIGS. 1 and 2 is positioned so that the surface shown in FIG. 1 is outwardly displayed on the article of clothing 11 onto which it is attached while the fastening strips on the peripheral edges of the rear surface of the pocket are positioned over the given area of the article of clothing onto which the pocket is to be attached. An iron or similar heating means is then applied to the front surface 33 of the pocket material, and the heat and pressure created by the iron enables the second or outer layer of the fastening strips to adhesively bond the side and bottom edges of the pocket to the clothing material for fixedly attaching the pocket thereto.

Figure 3:
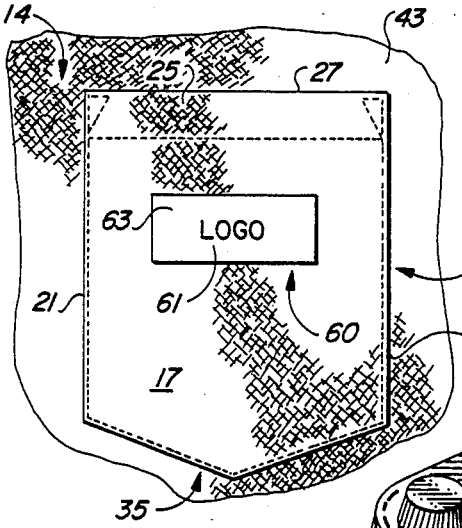
FIG. 3 is a front plan view of the pocket of FIG. 1 having indicia means thereon.

FIG. 3 shows a cut out section of pocket material 15 fixedly secured to clothing material 11 such as the material of a T-shirt 43. The pocket 15 includes a top edge 27 forming the pocket opening 73 and a folded back top pocket portion 25. The pocket of FIG. 3 also shows opposite and parallel sides 21 and 23, a bottom edge portion 35, and a front surface 17. Attached to the front surface 17 is an indicia means 60 such as a patch 63 containing a logo 61 or the like. The patch 63 is representative only and could be, for example, a heat transfer indicia, a silk screened indicia, a printed indicia, an embroidered indicia, or any similar form of indicia means known in the art.

Figure 4:
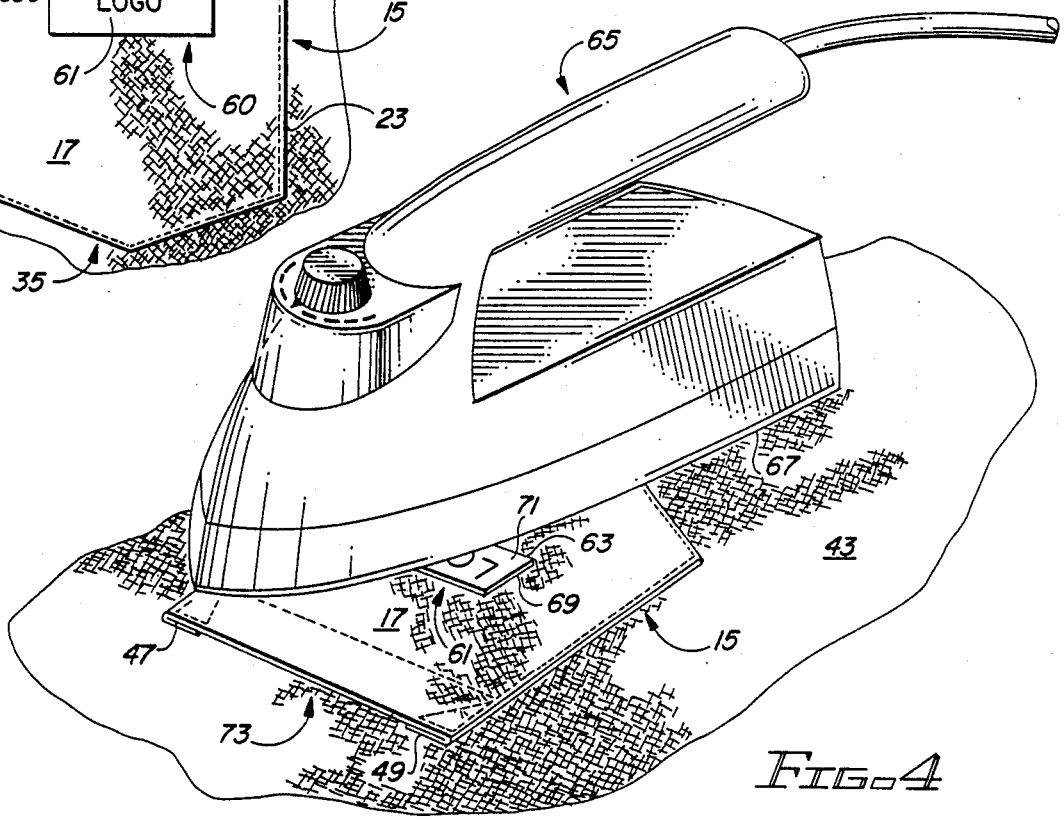
FIG. 4 is a perspective view showing the pocket being attached to an article of clothing by the application of heat thereto.

FIG. 4 shows a conventional iron or steam iron 65 heated to a predetermined temperature and having its lower hot surface 67 being moved across the pocket 15 so as to seal the fastener strips such as side strips 47 and 49 and the bottom strips 51 and 53 to the material 43 of the shirt onto which the pocket 15 is being affixed. The front surface 17 of the pocket 15 is shown as including an indicia means 60 which includes a patchlike portion 63 having a front or forward facing surface 71 with indicia means 61 thereon. This could also have a strip of the two layer material attached to the back thereof by sewing or the like so that it is also being secured to the front surface 17 of pocket 15 by the application of heat from the bottom 67 of the iron 65, or it could be sewn thereon, heat transferred, silk screened, or otherwise placed on the front 17 of the pocket 15 as known in the art. The pocket opening is designated by reference numeral 73 as being located between the top edge portion 27 of the pocket 15 while the interior of the pocket is defined as lined opposite the front surface 17 and between the adhesive strips of the sides 47 and 49 and the bottoms 51 and 53, respectively. The heat from the iron 65 activates the adhesive in the second layer and causes it to be adhesively bond in a permanent manner to the material 43 of the T-shirt 11 as previously described.

While specific apparatus has been used to describe the preferred embodiment of the present invention, it will be understood by those skilled in the art that various modifications, variations, changes and substitutions may be made in the apparatus of the present invention without departing from the spirit and scope thereof which is limited only by the appended claims.

We claim:

1. An iron-on pocket for application to shirts and the like after manufacture and initial distribution comprising:

a single unitary piece of material formed in the shape of a pocket, said material having a top edge, and first and second side edges for defining a central pocket portion therebetween;

a predetermined portion of the outer peripheral end portions of each of said bottom edge and said first and second opposite sides being adapted to be folded back toward one another and disposed over the outer edge portion of the remaining bottom edge portion and said side portion, said folded back portions facing the rear of said pocket;

strips of relatively flat, tape-like fastening means having an adhesive means on one surface thereof, one of said strips being operably disposed over each of said folded back portions such that said adhesive means surface is disposed toward the rear of said pocket;

stitching means for fixedly attaching said strips of fastening means to each of said folded back portions and to the opposing remaining bottom edge portion and side portions for forming a unitary pocket patch;

an indicia means operatively secured to the front of said pocket; and said adhesive means coated surface of said strips of fastening means being disposed against said shirt at a predetermined location thereon where it is desirable to add a pocket and being responsive to the application of heat thereto for adhesively bonding said pocket to said shirt.

2. The iron-on pocket of claim 1 wherein said indicia means includes at least one of embroidery, fabric lettering, fabric material, heat transfers, silk screened indicia, embossed letterig, printing and painting.

3. The iron-on pocket of claim 2 wherein said indicia means includes means for threadedly securing indicia means to the front surface of said pocket material.

4. The iron-on pocket of claim 2 wherein said indicia means is adapted to be adhesively secured to the front surface of said pocket material by a heat transfer process.

5. A piece of pocket material adapted to be secured to the surface of an article of clothing suitable for receiving said pocket and after the initial manufacturing process is complete, said pocket-forming material comprising:

a piece of pocket material cut into the shape of a conventional pocket and including a bottom portion and a pair of side portions;

elongated strips of fastening means, each having one surface adapted to be operably disposed over the rear edges of said bottom portion and said side portions on the rear of said side portions on the rear of said pocket, the opposite surface of each of said strips facing the shirt portion to which said pocket is to be attached including adhesive means;

stitching means for fixedly securing said strips of fastening means to said rear edges; and indicia means fixedly secured to a front surface portion of said pocket;

said adhesive means being responsive to the application of heat to the outside surface of said pocket for fixedly securing said pocket to said shirt; and the non-adhered top edge portion of said pocket material forming the pocket opening and the pocket being defined between the rear surface of the pocket material onto whose side and bottom peripheral edges said fastening means are secured and centrally disposed therebetween and the clothing material onto which said pocket material is secured.

6. An iron-on pocket for a pocketless shirt which includes a shirt material, said pocket comprising:

a piece of pocket material substantially equivalent to said shirt material and cut in the form of a pocket having a top, a bottom and a pair of sides, a front surface, and a rear surface adapted to be operatively disposed against said shirt material;

attachment means including strips having a first surface adapted to be fixedly secured to the interior surface of said pocket material proximate the bottom and side edges thereof and a second opposite surface including an adhesive layer operatively carried by said second surface and having its outer heat-responsive adhesive layer adapted to be disposed against the shirt material at the location said pocket is to be attached, said adhesive layer being responsive to the application of heat thereto for adhesively bonding the side and bottom edges of said pocket material to said shirt material for forming a pocket therebetween; and said strips being fixedly secured to said bottom and side edges by stitches before said pocket is disposed over the portion of shirt material to which it is to be attached.

7. The iron-on pocket of claim 6 wherein the peripheral edge portions of said sides and said bottom are folded back upon the rear surface of said pocket material, wherein said strips of attachment means are operatively disposed over the folded back portion of said peripheral edges and the outer adhesive layer of said second surface being disposed on the shirt material at the location the pocket is to be attached so that the application of heat thereto adhesively bonds the second surface to the shirt material and thereby bonding the side edges and bottom edge of the pocket material to the shirt material for forming a pocket having an opening at the unsecured top edge of said pocket material and a pocket interior defined as that space between the outer surface of shirt material covered by said pocket and the intermediate body portion of the rear surface of said pocket material.

8. The iron-on pocket of claim 7 wherein said side and bottom portions are folded back upon the rear surface of the pocket means and said fastening strips are disposed thereover and secured thereto by sewing means for attaching the folded rear edge and front edge of the sides and bottom of pocket material to the fastening strips.

9. The iron-on pocket of claim 6 wherein said indicia means is embroidered to the front surface of said pocket material.

10. The iron-on pocket of claim 6 wherein said indicia means includes at least one of embroidery, fabric lettering, fabric designs, patches, and non-fabric indicia adapted to be sewn thereon.

11. The iron-on pocket of claim 6 wherein said indicia means includes at least one of a name, symbol, logo, trademark, advertisement and company-identifying symbol.

* * * * *